United States Patent [19]

Jouanno

[11] 4,063,241

[45] Dec. 13, 1977

[54] RADAR REFLECTOR

[76] Inventor: Rene-Jean Jouanno, 27, rue Moliere, Limours, France

[21] Appl. No.: 721,868

[22] Filed: Sept. 9, 1976

[30] Foreign Application Priority Data

| | | |
|---|---|---|
| Sept. 22, 1975 | France | 75.28907 |
| Mar. 31, 1976 | France | 76.09275 |

[51] Int. Cl.[2] ..... H01Q 15/20

[52] U.S. Cl. ..... 343/18 B; 343/18 C

[58] Field of Search ..... 343/18 B, 18 C

[56] References Cited

U.S. PATENT DOCUMENTS

| | | | |
|---|---|---|---|
| 2,452,822 | 11/1948 | Wolf | 343/18 C |
| 2,604,644 | 7/1952 | Telfon | 343/18 C |
| 2,702,900 | 2/1955 | Matson, Jr. | 343/18 C |
| 2,778,010 | 1/1957 | Leonard | 343/18 C |
| 3,152,329 | 10/1964 | Lowery et al. | 343/18 C |
| 3,283,328 | 11/1966 | Wood | 343/18 C X |
| 3,451,060 | 6/1969 | Edwards | 343/18 C |

FOREIGN PATENT DOCUMENTS

| | | | |
|---|---|---|---|
| 718,516 | 11/1954 | United Kingdom | 343/18 C |

*Primary Examiner*—Malcolm F. Hubler

*Attorney, Agent, or Firm*—Brisebois & Kruger

[57] ABSTRACT

A radar reflector is made from six ribs which may be formed from six pairs of rods hinged to a central hub so that when unfolded the ribs are mutually orthogonal. The reflecting surface comprises three squares of reflecting material interconnected along lines cut from the center of each square to an edge portion thereof so as to form a helix.

10 Claims, 13 Drawing Figures

Fig. 2
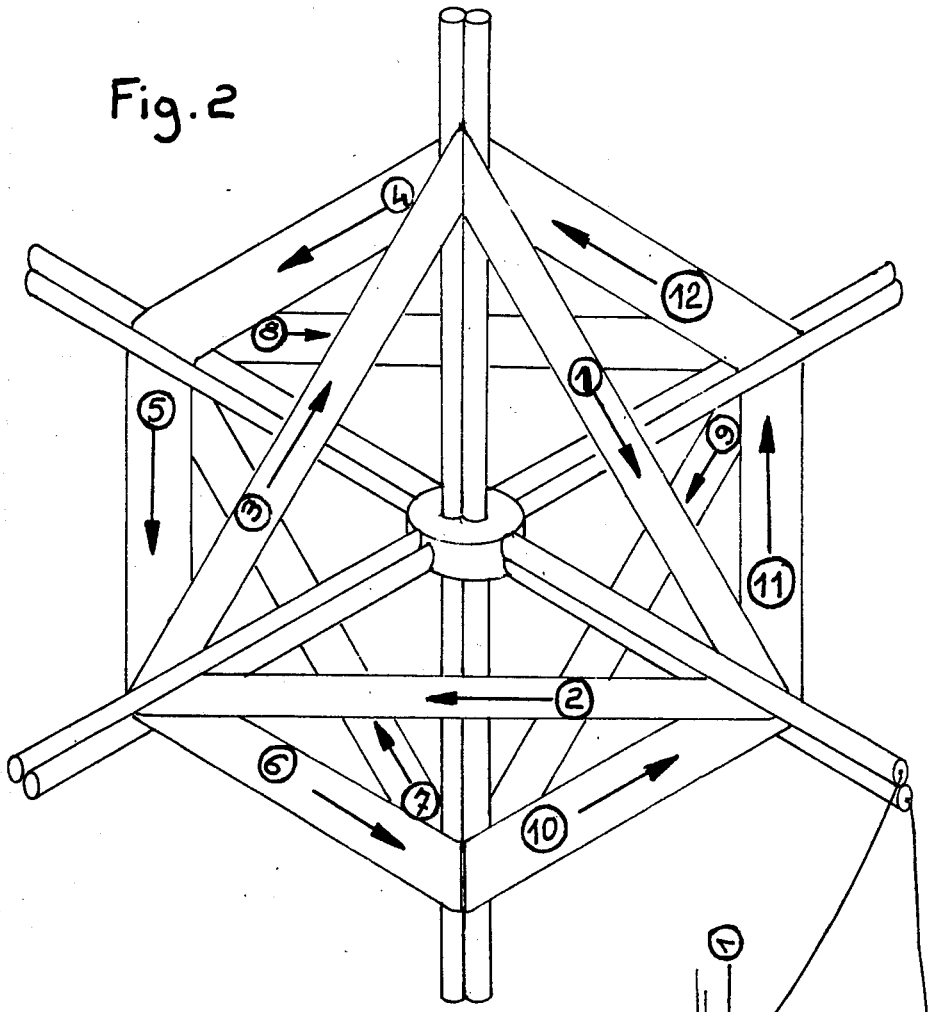
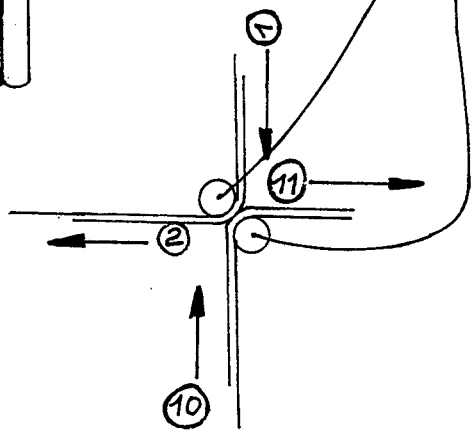
Fig. 3

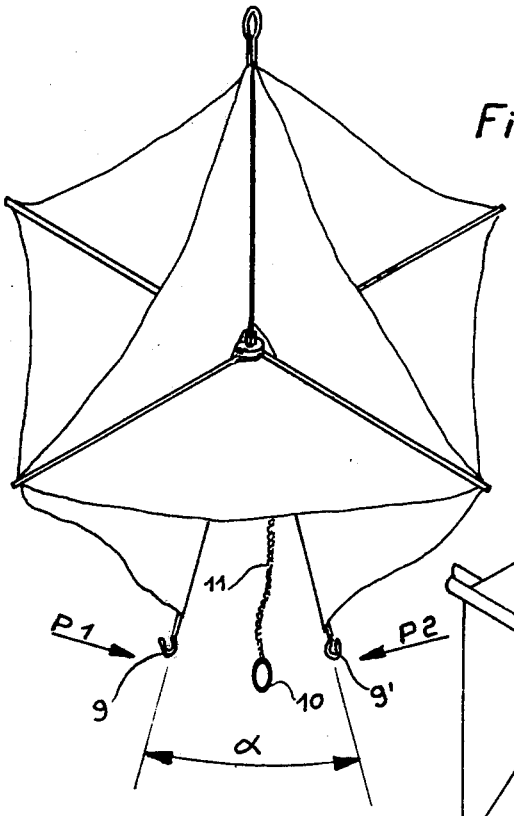
Fig. 7.
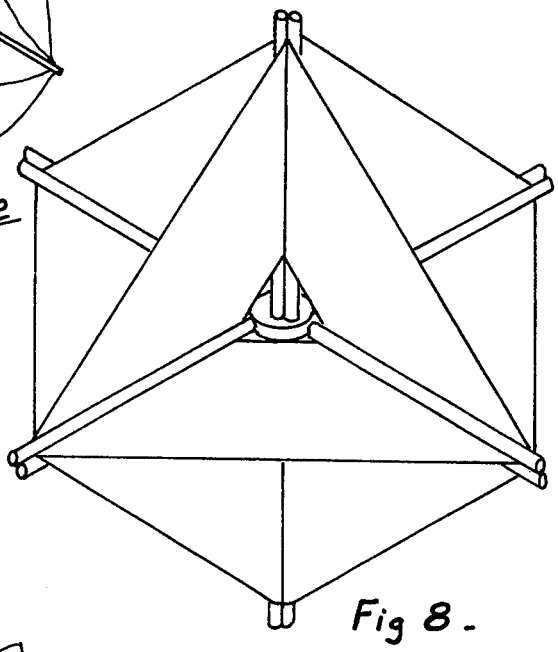
Fig 8.
Fig. 10.
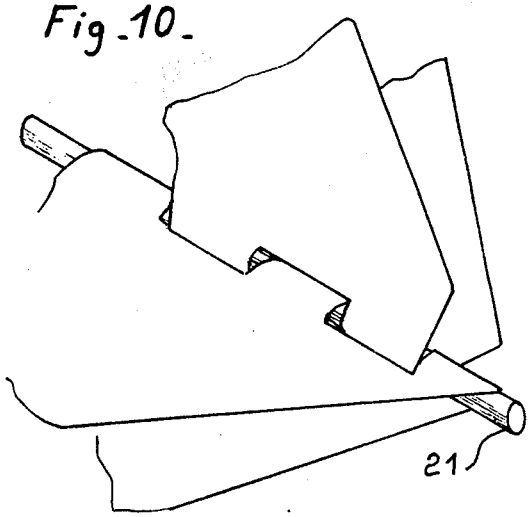
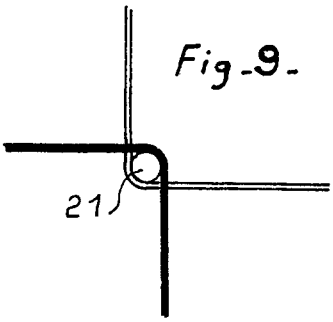
Fig. 9.

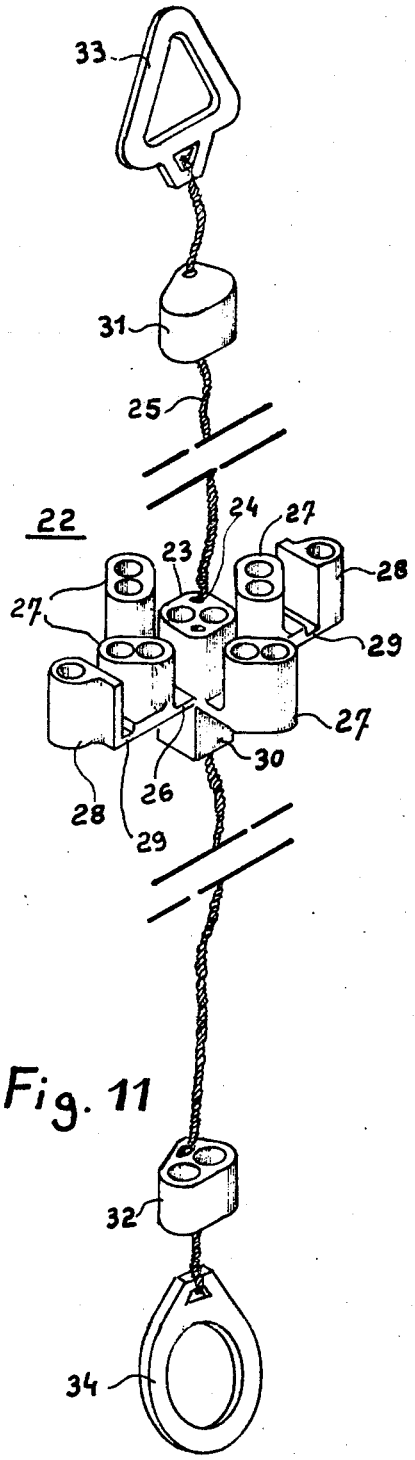
Fig. 11
Fig. 12
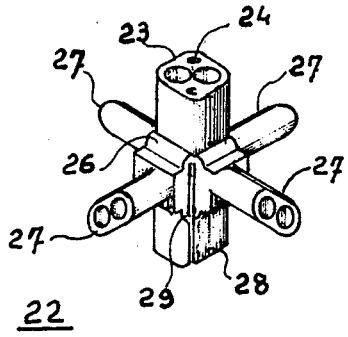
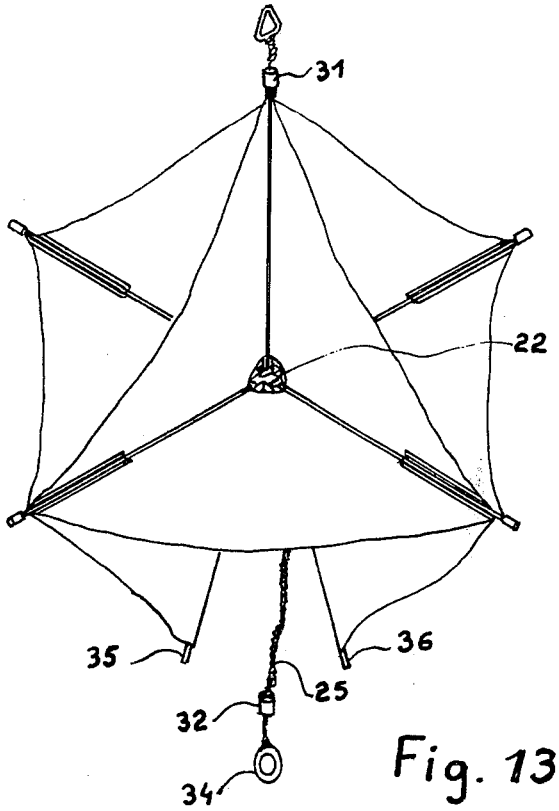
Fig. 13

RADAR REFLECTOR

BACKGROUND OF THE INVENTION

1. Field of the Invention

The present invention relates to a radar reflector intended for use as a target when making meteorological observations.

Devices of this kind represent an assembly of similar tetrahedrons. Each tetrahedron has three equal and mutually orthogonal faces in the shape of right-angled isosceles triangles and these faces are formed from a reflecting material. The fourth face or base is not physically present.

This assembly of tetrahedrons occupies a volume of space at the centre of which the apices of all the tetrahedrons are situated, with pairs of the tetrahedrons sharing one common face.

2. Description of the Prior Art

In the present state of the art, such reflectors may be divided into two kinds:

a. those which are supplied in pieces and which are put together by the user as and when needed. The assembly operation requires care and must necessarily be carried out near the launching site and with good conditions for assembly. It is impossible in the dark or in strong winds, and b. those which are assembled at the manufacturing stage and are then stored in a folded state and need only be unfolded and locked to be ready for use. Reflectors of this type assume broadly the shape of an umbrella.

The complexity of systems currently on the market is such that the weight and cost of the devices is too high and despite their undoubted advantages they are at present only used in special cases.

It is thus a primary object of this invention to provide an improved radar reflector, and in particular to provide a radar reflector which is robust and which can be rapidly assembled for use from a folded configuration.

SUMMARY

Accordingly the present invention consists a folding radar reflector of the kind which is made up of eight mutually adjoining right-angled tetrahedrons having a common apex, with the bases of the said tetrahedrons are not being physically present but forming a regular octahedron whose centre is the said common apex, wherein the reflector has a covering which before being fitted is formed by three squares of a flexible reflective material, each of which is cut either along one half-diagonal, i.e. along a line joining the centre of the square to one of its corners, or along a line which may or may not be straight, joining the centre of the square to one of its edges, and each square being joined to another square at the said half-diagonals or at the said lines in such a way as to form a helix the said covering being held under the tension by a rigid frame after the said reflector has been unfolded.

In accordance with a feature of the invention the said frame may be secured to a central hub which forms a hingepoint.

In accordance with another feature of the invention the said frame may be formed by six pairs of rods which are hinged to the central hub and which are parallel when the reflector is folded and lie in mutually orthogonal pairs when the reflector is unfolded.

In one embodiment a cover protects the reflector when folded and ensures that it occupies the minimum space. This being the case, the reflector is opened by pulling on an opening ring which causes the protective cover to tear and allows the reflector to be spread out.

With this particular arrangement, only a very short space of time between the moment when the reflector is still packed up and the time when it is released, is required to bring the reflector into operation. What is more, this operation can be carried out under any conditions.

BRIEF DESCRIPTION OF THE DRAWINGS

In order that the present invention may be more clearly understood an embodiment thereof will now be described by way of example and with reference to the accompanying drawings, in which:

FIG. 2 shows an example of how a covering can be looped around the frame of FIG. 1, FIG. 3 shows a detail of FIG. 2.

FIG. 7 shows the reflector partially unfolded,

FIG. 8 shows the reflector fully unfolded,

FIGS. 9 and 10 relate to another way of fitting the cover,

FIG. 11 shows another type of central hub which can be used,

FIG. 12 shows the hub of FIG. 11 in the position which it occupies when the reflector is unfolded, and FIG. 13 shows a reflector fitted with the hub of FIGS. 11 and 12 when partly unfolded.

DESCRIPTION OF THE PREFERRED EMBODIMENTS

Figure 1:
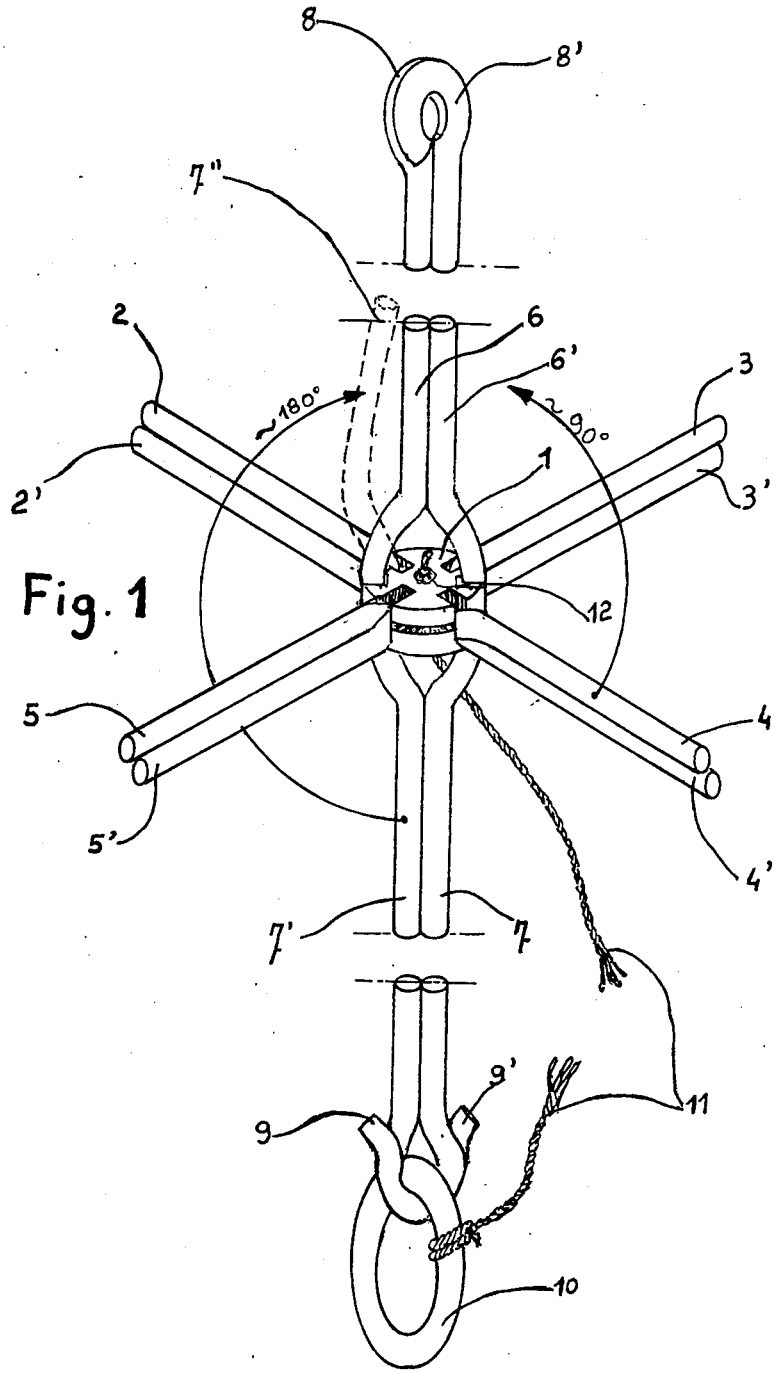
FIG. 1 is a diagrammatic view of the frame of a reflector according to the invention with a first type of central hub.

In FIG. 1, which shows the frame of a reflector constructed in accordance with the present invention, a central hub 1 holds the six ribs of the frame. Each of the ribs is formed by two rods joined side by side. With the reflector in a state ready for use, all these ribs are orthogonal to one another, while in the folded position they are grouped together and are substantially parallel to the upper rib formed by rods 6 and 6'.

In the embodiment which is now being described, this upper rib is fixed while the four horizontal ribs, which are formed by rods 2 and 2', 3 and 3', 4 and 4', and 5 and 5' respectively, are hinged to the hub 1 and are able to move upwards through an arc of a circle substantially equal to 90° so as to lie parallel with the upper rib, i.e. to rods 6 and 6'. As for the lower rib, the two rods 7 and 7' from which it is formed each move through an arc of a circle of close to 180°, which enables them to lie adjacent to the other rods which have already been folded. In FIG. 1, the position 7'' which rib 7' occupies when folded can be seen indicated in broken lines.

In the embodiment being described the fixed rods 6 and 6' each terminate at the opposite end from the hub in loops 8 and 8' intended for suspending the reflector.

Similarly, the bottom parts of rods 7 and 7' are formed into hooks 9 and 9'. These hooks are locked by means of a ring 10 which is connected to the hub 1 by a cable 11 and a knot 12, or by any other suitable means. The hooks can be directed either towards one another (FIG. 1) or away from one another (FIG. 7) without the need to make any alteration in the method of locking used.

Before describing the preparation of the covering for the reflector, it is essential that the principle underlying it should be explained with reference to FIG. 2, which, by means of the numbered arrows shown on the string representing the covering indicates one of the many possible schemes. It can be seen that the covering can be looped around the rods with a fold at each quarter turn of 90° without ever passing through the same point twice. FIG. 3 is a detailed view showing the loops around each of the two rods forming one of the ribs.

Figure 4:
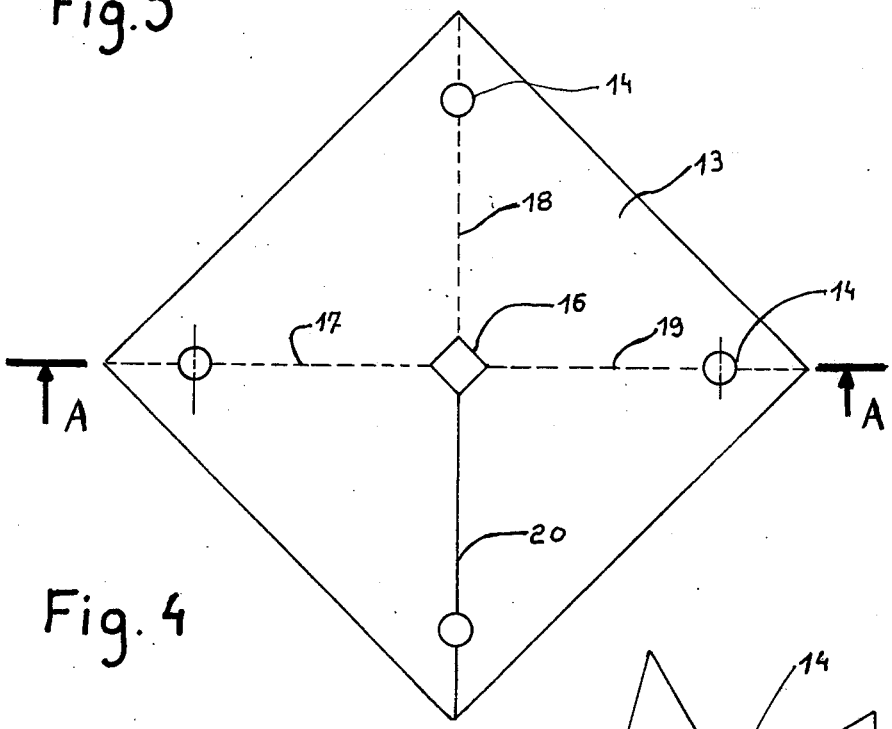
FIG. 4 shows one of the three squares forming a covering for the reflector.
Figure 6:
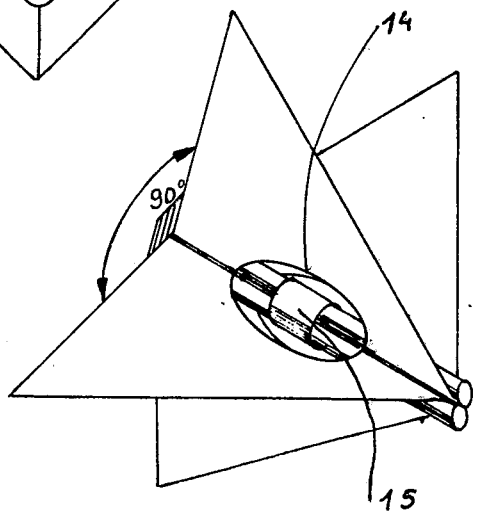
FIG. 6 shows a detail of the reflector when unfolded.

The covering (FIG. 4) is made from three squares 13 of a flexible reflecting material which exactly coincide in all respects when laid on top of one another, and in which holes 14 may be formed, if it is considered helpful, these holes being intended:

1. to assist location during assembly,
2. to allow passage to a ring 15 (FIG. 6) which holds together the two rods making up a given rib (except in the case of the lower rods 7 and 7').

Figure 5:
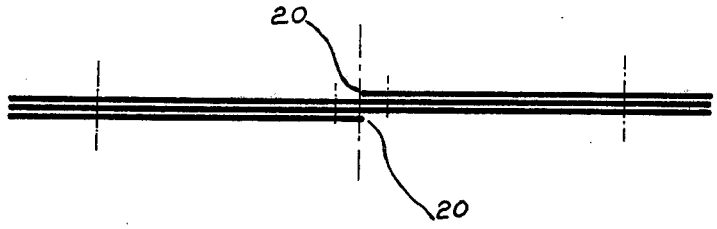
FIG. 5 is a sectional view of line A—A of FIG. 4 when the three squares are joined together in accordance with the present invention.

At the centre of each of the squares is formed an opening 16 intended to accomodate the hub 1. At assembly, the rods of the frame come into position along the half-diagonals 17, 18, 19, and 20. It is a particular feature of the half-diagonals 20 that a cut is made along one half-diagonal of each square and that the cut edges of one square is there joined to the cut edge of another square to form a helix (FIG. 5) about an axis formed by superimposing the centres of the three squares. The helix may equally well be arrived at by cutting the said squares not along a half-diagonal but along a line, straight or otherwise, joining the centre of each square to one of its edges.

In another method of construction, each square may be fitted separately but it is then necessary to make the three joins when fitting the squares to the frame. It is also possible to use twelve right-angled isosceles triangles each representing a quarter of one of the three squares, but it is then necessary to make a connection to one of the twelve rods on all the diagonals.

Similarly it may be found beneficial to reinforce the corners of the squares forming the covering to form pockets for the ends of the horizontal rods for example, and to reinforce the central hole, while possibly at the same time forming guides in the reinforcement to assist in fitting the rods.

FIG. 7 shows the reflector in the course of unfolding. The covering is caused to assume its final, tensioned form merely by bringing together hooks 9 and 9' by pressure in the directions of arrow P1 and P2 so that angle is reduced to zero. The two hooks are locked by inserting the ring 10 in the way illustrated in FIG. 1.

FIG. 8 shows the reflector fully unfolded and tensioned. To simplify the drawing, the holes 14 and the articluation of the rods in the hub 1 are not shown in FIG. 8.

A modified way of fitting the covering is shown in FIGS. 9 and 10 where the frame used has ribs which each consist of only one rod 21. In this case, the covering has to be cut away along each of its diagonals after the fashion of a hinge.

Other modifications to the reflector are also possible. Thus, in the case of the central hub to which the various ribs are hinged rather than a hub 1 made of rigid parts it may be preferable to use the hub which will now be described and which, be virtue of its particular configuration and by folding at certain points, allows a transition from the folded form to the unfolded form without the use of rigid pivot pins.

As can be seen in FIG. 11 the hub 22 is formed by a cruciform spider. On the upper side, and in the centre, it has a block 23 which is pierced by a pair of blind vertical holes intended to hold the upper vertical rods. In the embodiment selected, the block has passing through it two small and similarly vertical holes 24 for the cable 25 to pass through. Adjoining the square base of the central block 23 and connected to it by webs which form hinges 26 are four other blocks 27 which each contain a pair of blind holes intended to receive the rods forming the horizontal ribs of the frame, after the web portions connecting each of them of the central block 23 have been folded through 90°. At either end of one of the arms of the cross are situated two half-blocks 28 which are connected to the arms by webs forming hinges 29. After being turned through 180°, these half-blocks 28, when each provided with a rod, form the lower vertical rib. Underneath the central block 23 is a cubical abutment 30 intended to prevent the webs which connect the blocks 27 to the central block 23, which remains fixed, from folding through more than 90°.

On the cable 25 there are two double end-caps 31 and 32 are able to slide symmetrically to hub 22 and which each contain two blind holes intended to hold the vertical rods captive. The upper end-cap 31 is supplied fitted to the ends of the upper vertical rods; the lower end-cap 32 is fitted by the user.

In the present emobodiment, a triangular eye 33 intended to allow the reflector to be suspended is attached to the upper end of the cable. To the lower end of the cable 25 is attached a ring 34 which is used to prepare the reflector for use. It is also used for hooking on a radiosonde under the reflector.

FIG. 12 shows the hub 22 deformed into the shape which it assumes when the reflector is fully unfolded, when it has six pairs of mutually orthogonal holes.

FIG. 13 shows the device unfolded but as yet untensioned. The reflector as a whole is tensioned by bringing together the two bottom angles of the covering represented by rods 35 and 36. The user unites the lower rods 35 and 36 by means of the double end-cap 32 by sliding it upwards on the cable 25. The reflector is then ready for use.

In a particular embodiment, the folded reflector is supplied in a sheath, made of plastics material for example, which can easily be ripped open by means of cable 11 or 25 by pulling on loop 10 or 34.

What I claim is:

1. A folding radar reflector of the kind which is made up of eight mutually adjoining right-angled tetrahedrons having a common apex, with the bases of the said tetrahedrons not being physically present but forming a regular octahedron whose centre is the said common apex, wherein the reflector has a covering which before being fitted is formed by three squares of a flexible reflective material, each of which is cut along one line joining the centre of the squares to the periphery thereof joining the centre, and each square being joined to another square at the said line of another square in such a way as to form a helix, the said covering being held under tension by a rigid frame after the said reflector has been unfolded.

2. A reflector according to claim 1 wherein said frame comprises a central hub and six rods hinged to said central hub, the rods lying parallel when the reflector is folded and mutually orthogonal when the reflector is unfolded, the covering being cut-away in the fashion of hinges at points where it intersects the rods.

3. A reflector according to claim 1, wherein said frame is formed by a central hub, and six pairs of rods which are hinged to said central hub, wherein the central hub is a cruciform and is made of a flexible plastics material so as to have a central block and arms extending therefrom, each arm incorporating a block which pivots through 90° in relation to the central block on a hinge which is formed by a web of plastics material, two half-blocks also being provided adjacent two opposing blocks, the said half-blocks pivoting through 90° in relation to blocks by means of a hinge.

4. A reflector according to claim 3, wherein the hub has an abutment which is situated below the central block and which restricts the pivoting movement of the blocks and the half-blocks.

5. A reflector according to claim 1, wherein the said frame is formed of six pairs of rods which are hinged to a central hub, these pairs of rods forming ribs which lie parallel when the reflector is folded and which are mutually orthogonal when the said reflector is unfolded.

6. A reflector according to claim 5, wherein the lower rods of the lower pair are provided at the ends with hooks which co-operates with a ring which holds them in the closed position, thus tensioning the covering to the reflector and locking the reflector in its assembled position.

7. A reflector according to claim 5, wherein means is provided to join together the two rods forming each rib, thus stiffening the rib, openings being formed for this purpose along the diagonals of the square forming the covering.

8. A reflector according to claim 7, wherein the central hub is so designed that two rods form an upper rib, four pairs of rods are able to pivot through an angle of 90°, and a final lower pair of rods able to pivot individually through 180°, whereby all the rods lie parallel to the rods of the upper rib when the reflector is folded.

9. A reflector according to claim 8, wherein an end-cap is provided which is equipped with two holes intended to receive the ends of the rods of the lower pair, thus locking the reflector in its assembled position.

10. A folding radar reflector of the kind which is made up of eight mutually adjoining rignt-angled tetrahedrons having a common apex, with the bases of the said tetrahedrons not being physically present but forming a regular octahedron whose centre is the said common apex, wherein the reflector has a covering which before being fitted is formed by three squares of a flexible reflective material, each of which is cut along one line joining the centre of the square to the periphery thereof joining the centre, and each square being joined to another square at the said lines of another square in such a way so as to form a helix, the said covering being held under tension by a rigid frame after the said reflector has been unfolded, said frame comprising a central hub, six pairs of rods hinged to said central hub so that two rods form an upper rib, four pairs of rods are able to pivot through an angle of 90°, and a final lower pair of rods able to pivot individually through 180°, whereby all the rods lie parallel to the rods of the upper rib when the reflector is folded, and wherein the lower rods of the lower pair are provided at the ends with hooks which co-operates with a ring which holds them in the closed position, thus tensioning the covering to the reflector and locking the reflector in its assembled position.

* * * * *